United States Patent [19]

Sommer

[11] 3,985,479

[45] Oct. 12, 1976

[54] ROTARY PISTON PUMP

[76] Inventor: Manfred Sommer, Talstrasse, D-7101 Untergruppenbach, (Baden-Wurttemberg), Germany

[22] Filed: Dec. 2, 1974

[21] Appl. No.: 528,733

[30] Foreign Application Priority Data

Dec. 5, 1973 Germany ..... 2360617
Nov. 29, 1974 Austria ..... 9590/74

[52] U.S. Cl. ..... 418/146; 418/148; 418/233; 418/263; 418/264

[51] Int. Cl.[2] ..... F01C 1/00; F01C 19/02; F01C 21/00; F04C 1/00

[58] Field of Search ..... 418/146, 148, 226, 233, 418/260, 261, 263, 264

[56] References Cited

UNITED STATES PATENTS

| | | | |
|---|---|---|---|
| 113,229 | 3/1871 | Webb | 418/233 |
| 120,548 | 10/1871 | Tate | 418/233 |
| 375,788 | 1/1888 | Williamson | 418/233 |
| 713,663 | 11/1902 | Mills | 418/233 |
| 872,801 | 12/1907 | Eek et al. | 418/146 |
| 964,431 | 7/1910 | Keating et al. | 418/233 |
| 2,135,161 | 11/1938 | Bendsil et al. | 418/133 |
| 2,338,112 | 1/1944 | Hell | 418/264 |
| 2,619,913 | 12/1952 | Longenecker | 418/264 |

FOREIGN PATENTS OR APPLICATIONS

| | | | |
|---|---|---|---|
| 230,929 | 2/1911 | Germany | 418/233 |

*Primary Examiner*—John J. Vrablik
*Attorney, Agent, or Firm*—Robert E. Burns; Emmanuel J. Lobato; Bruce L. Adams

[57] ABSTRACT

A rotary piston pump comprises vanes mounted on shafts extending radially from a hub and travelling around an annular channel having a forwarding or pumping portion of circular cross section and a restricted sealing portion corresponding in cross section to the diametrical cross section of the vanes. Control means is provided for turning the vanes about radial axes so as to position the vanes approximately perpendicular to their direction of movement while passing through the forwarding portion of the channel and to turn them approximately 90° so as to pass through the sealing portion of the channel in an edgewise position. At the ends of the forwarding portion the channel is connected respectively with inlet and outlet passageways. The control means include springs which permit the vanes to rotate in order to give way in the event that foreign bodies penetrate and have eccentrics and cam tracks, with cam rollers or cams if necessary.

28 Claims, 15 Drawing Figures

ROTARY PISTON PUMP

FIELD OF INVENTION

The invention relates to rotary piston pumps and in particular to pumps having a plurality of vanes travelling around an annular channel provided with inlet and outlet ports. The pump is suitable for pumping almost any fluid medium and especially suitable for pumping either viscous or non-viscous liquids which may or may not contain solid pieces or particles. A pump in accordance with the invention is particularly useful in handling beverages, food stuffs, chemicals, as well as waste water, liquid manure, concrete and other media containing very coarse constituents.

BACKGROUND OF INVENTION

Many different pumping systems and constructions are well known. Apart from piston pumps and centrifugal pumps there are various rotary piston pumps which seek to combine the advantages of the piston pump and the centrifugal pump. However, in practice many difficulties are encountered. These difficulties relate, in particular, to control of the vanes.

The design according to U.S. Pat. Application No. 311,816, now U.S. Pat. No. 3,895,893, and other disclosures of the inventor provide, among other things, for eccentric control stubs, guided in cam tracks, on the bearing shafts of the vanes. Simple cam guides of this type, which are also common for other displacements, are sufficient for many applications. However the pump according to the present invention is also intended for use with media which are of especially high quality or for contaminated media, which in addition often contain relatively coarse constituents. An effort is therefore made to avoid corners and edges in the pump channel and, in particular, in the inlet and output areas as well, so that ramps in front of the entrance to the sealing portion of the channel should be avoided wherever possible. However there is then an increased danger of jamming if media containing coarse constituents are pumped. Since, for reasons of space, only small eccentricities, relative to the size of the vanes, can be employed at the ends of the control stubs, although an effort will be made to design them as large as possible, these control stubs will be subjected to considerable forces. Even constituents in the medium to be pumped which are not actually that hard can therefore easily lead to damage to or breakage of the control means and/or the vanes.

SUMMARY OF INVENTION

It is an object of the present invention to produce a pump which is simple in construction and operation and is characterized by laminar flow of the fluid stream, high capacity with small size and high suction power. The pump in accordance with the invention makes possible smooth operation comparable to that of a centrifugal pump and moreover minimizes crushing or turbulence in the medium being pumped. It is almost wholly insensitive to foreign bodies, protected against dry running and is wear resistant. Moreover, it can be operated in either direction.

In accordance with the invention there is provided a rotary piston pump having pump chamber in the form of an annular channel having a forwarding or pumping portion of circular cross section and a sealing portion of restricted cross section. Disc-like vanes mounted on shafts extending from a hub rotatably concentrically with the annular channel are disposed in the channel and travel circumferentially around it as the hub rotates. The vanes are rotatable about their axes radial of the hub and the turning of the vanes is cyclically controlled so that the vanes pass edgewise through the sealing portion of the channel while being turned approximately perpendicular to their direction of movement in the forwarding or pumping portion of the channel. Inlet and outlet passages are provided respectively at opposite ends of the forwarding portion of the channel. Suitable means provides fluid tight seals between the relatively moving parts of the pump.

In accordance with the invention the distance between two adjacent vanes and the length of the sealing portion of the channel are coordinated so that the next following vane has entered the sealing portion of the channel to provide a complete seal before the preceding vane has passed out of the sealing portion of the channel. There are cyclically acting means with cam track flanks which operate conjointly with the eccentric portions. The control means contain elastic means which permit the vanes to yield to a foreign body or similar item if necessary through the rotation of the respective vane. This allows the vanes to yield temporarily to a foreign body without being damaged and to then return to the desired position again. In this connection, the precise guidance along a flank ensures that the vanes assume the proper attitude on entering the sealing portion of the channel, thereby avoiding damage and breakage. The arrangement of springs in the control means avoids hard travel of the control elements, thereby significantly improving the quietness of operation of the entire pump, especially at high speeds. If a further auxiliary guide flank, with corresponding elements, is provided, the efficiency of the pump is significantly increased, as the pump drive does not constantly have to work against the springs, as both cam rollers or other elements normally follow the configuration of the flanks, without compressing the springs. The springs are only pressed in the event of penetration of foreign bodies or to provide other compensation. This consequently also significantly reduces the risk of the springs' breaking and resulting damage to the control means of the pump. Supporting the springs against the auxiliary guide flank by means of cam support rollers reduces friction and results in quiet operation. The springs could also be supported against the eccentric control stubs by means of a connecting rod design; however this requires considerable fabricational effort and results in irregular movements in the control members, with those members upon which the connecting rods act being subjected to corresponding strains. Strains of this nature can be avoided by utilizing the cam rollers, which are on the control stubs anyway, for supporting the springs by means of a further supporting roller. This results in a solution which is favourable in terms of quietness of operation, fabricating technology and operating technology. It is possible to employ two similar roller holders, with the springs being supported in an advantages manner therebetween. In this manner, the springs can be surrounded on all sides, thereby preventing members which could cause damage from reaching contact and sliding surfaces in the event a spring breaks. Undesired twisting can be prevented in various manners, for example by means of keys, splines or other irregular configurations.

This is possible in an essentially simple manner with a hexagon design, which operates without canting.

It is a further object of the present invention to provide very simple spring means. In this connection, spring means can be provided for an entire cam track member, having an auxiliary guide flank. The cam track member can be slidable in one axis, against the pressure of a spring.

It is a further object of the present invention to provide good adjustment of the pump control means. This can be achieved through axial setting of the cam track members. This is especially important since, if the vanes are not precisely positioned when they enter the sealing portion of the channel, serious damage and breakdowns can result. The pump according to the invention can be set for completely quiet operation in a very simple manner.

It is a further object of the present invention to prevent undesired swivelling of the vanes as a result of the installation of the spring, especially when they enter the sealing portion of the channel. This can be accomplished by positive guidance of the cam rollers in this area, for example with a butting area which can prevent undesired, excessive swivelling and/or tumbling of the vanes as they pass through the pumping portion of the channel. A second cam roller on each control stub prevents sliding friction, on the one hand, while offering, primarily, space for locating the spring support roller in a design according to the invention.

It is a further object of the invention to design improved cam control, permitting the greatest possible degree of leverage and the widest possible rotational paths. In a pump according to the present invention, this is accomplished in that specially designed cam tracks are employed in the largest possible circular path and that correspondingly adapted cams are employed on the bearing shafts. Control means of this type are insensitive to the penetration of dirt and to fabricating tolerances and wear, whereby the fact that many components are designed of plastics also contributes thereto.

A further object of the present invention is the design of favourable sealing means for the vanes. Appropriate, elastic sealing strips or elastically arranaged sealing rings provide elastic guidance, with good operating characteristics, of the vanes in the pumping portion of the channel with good sealing. This prevents damage and breakage in the event that foreign bodies are jammed in, while also compensating for slight parallel displacement of the swivel axes toward the radii, which has proven to be practical due to the eccentric position of the adjusting members.

BRIEF DESCRIPTION OF THE DRAWINGS

The objects, characteristics and advantages of the invention will be more fully understood from the following description in conjunction with the accompanying drawings in which.

DESCRIPTION OF PREFERRED EMBODIMENTS

Figure 1:
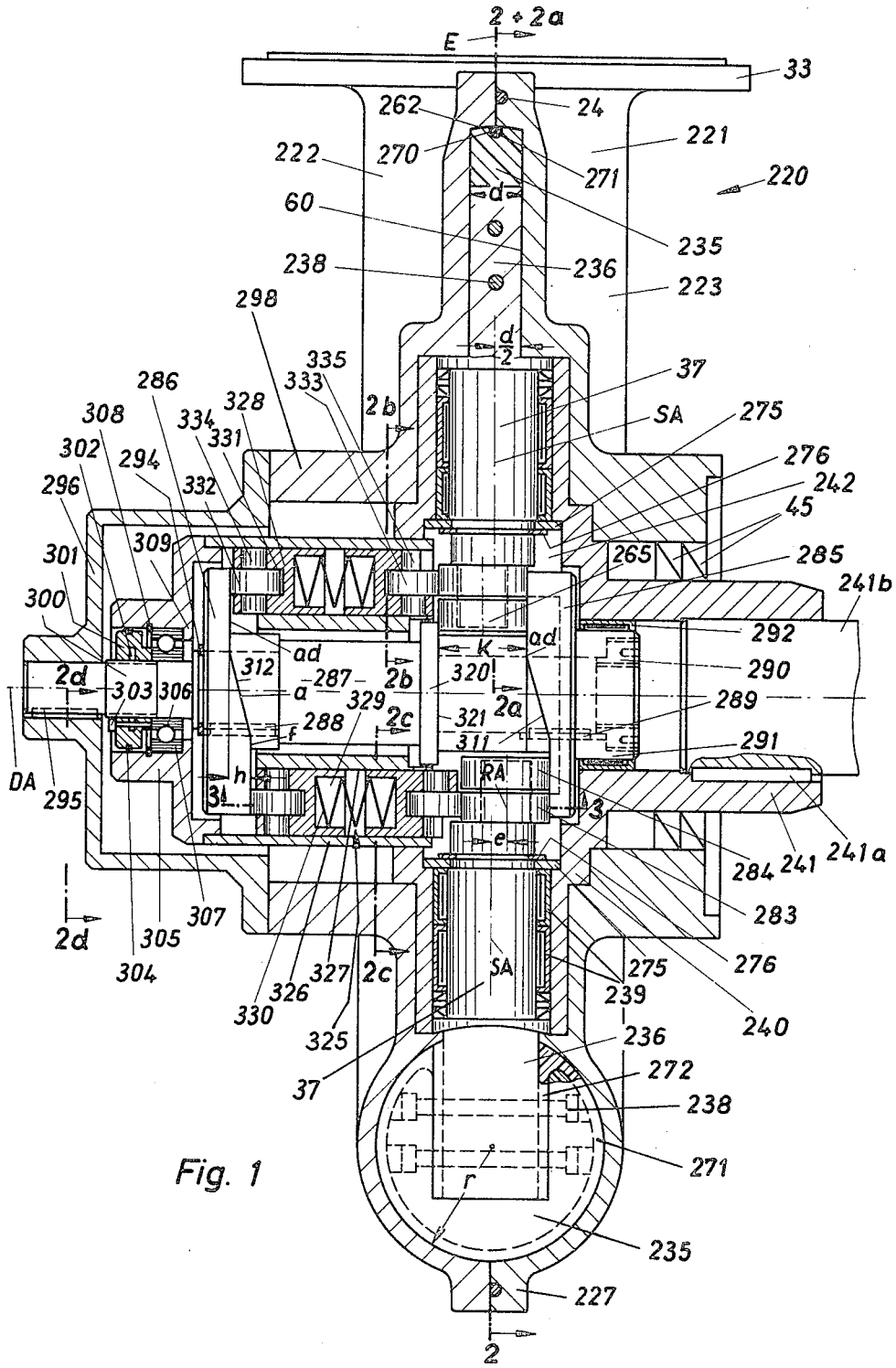
FIG. 1 is a cross section through a first embodiment of a pump in accordance with the invention, the section being taken on the line 1—1 in FIG. 2, whereby the line along which the section is taken is not straight, but is partially staggered to better illustrate the vanes and bearing shafts because of the staggered swivel axes.
Figure 2:
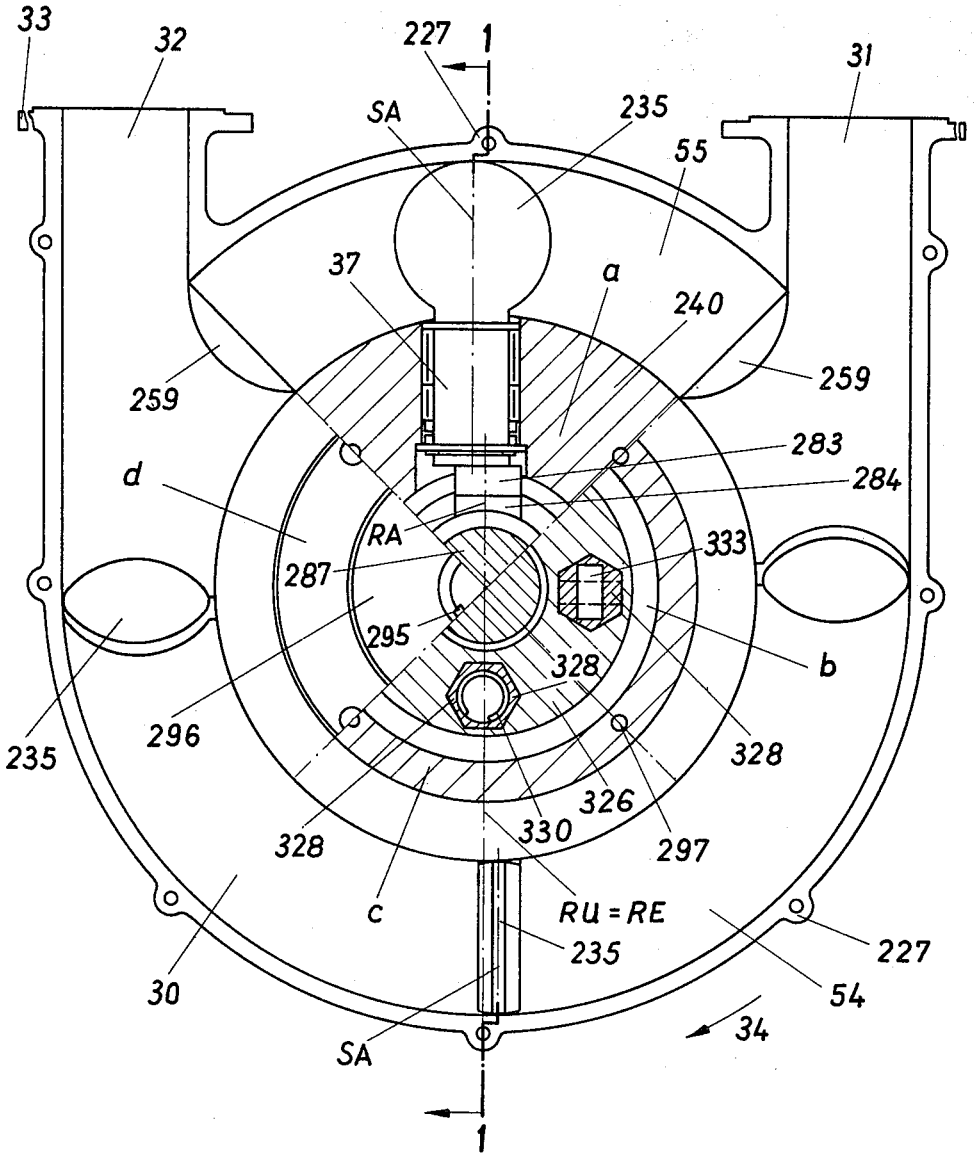
FIG. 2 is a central section through the pump shown in FIG. 1 taken along lines 2—2, whereby in the four sectors of the control portion, divided by four lines extending at 45° to the edges of the page, various planes are illustrated for showing the various portions of one and the same practical example of the pump; the respective sectors and planes of the sections are designated with the letters *a* to *d* in FIGS. 1 and 2; the scale is smaller than that of FIG. 1.
Figure 3:
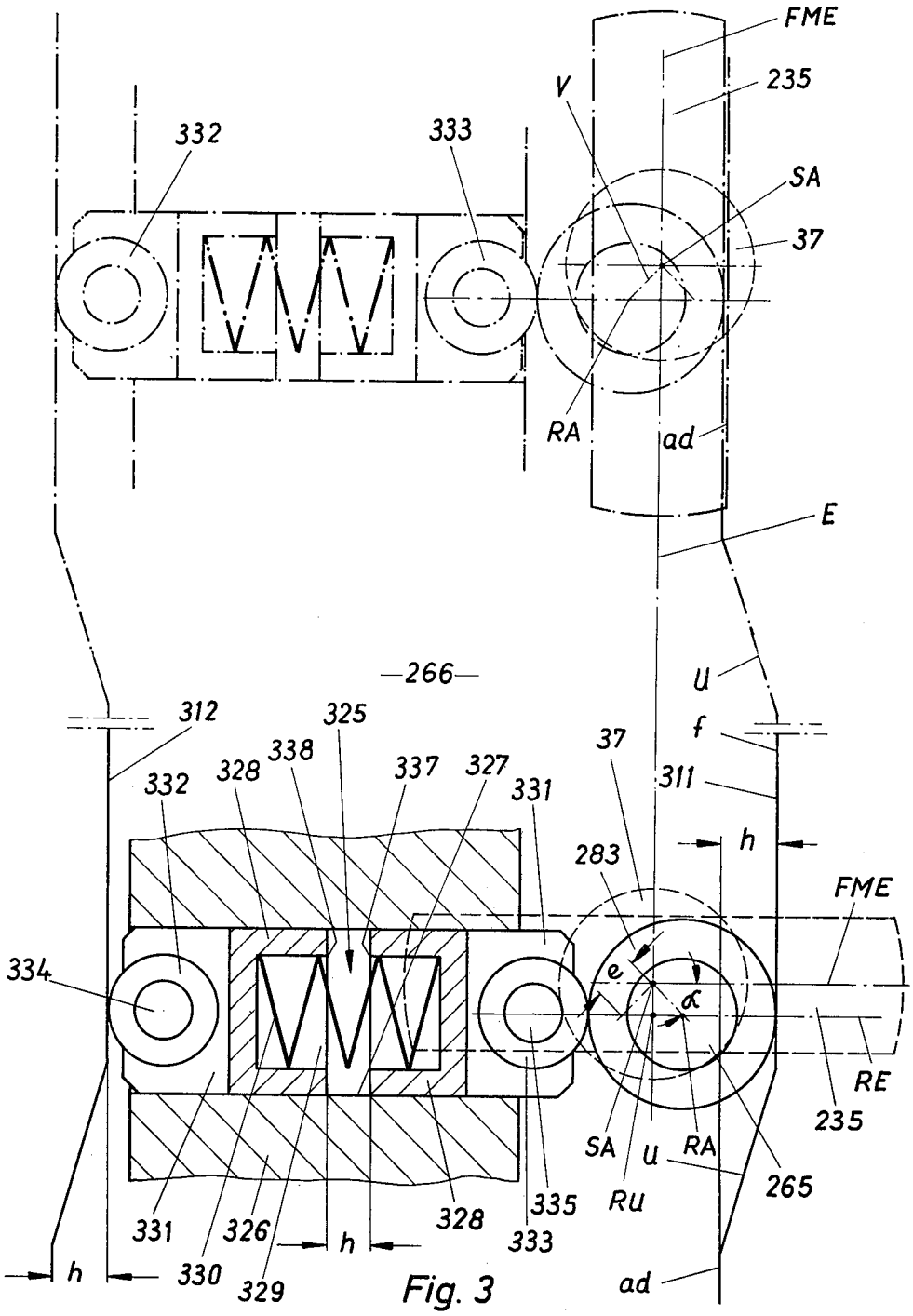
FIG. 3 is a partially schematic, enlarged partial section taken along line 3—3 in FIG. 1, showing the second position of the adjusting means with dash-dotted lines and in a sequential manner.

The practical example shown in FIGS. 1 to 3 shows a pump 22*o* having a pump casing 221 which is formed of the two casing members 222 and 223 which are divided along the partial plane and main plane of rotation E and are united by means of bolts extending through eyes 227. A fluid tight connection is provided by the interposed O-ring-gasket 24.

Formed in pump casing 221 is an annular channel 30 which, as can be seen from FIG. 1, is of circular cross section with a radius *r*. Connecting passageways 31 and 32 open tangentially into channel 30*o* and are provided with flanges 33 for the connection of inlet and outlet lines. Although the pump is arranged for right and left-handed operation, connecting passageway 31 will, for convenience, be designated as the inlet or suction connection and connecting passageway 32 as the outlet or pressure connection. They operate in this manner when the pump operates clockwise in accordance with arrow 34 in FIG. 2.

A plurality of vanes 235 in the form of circular discs rotate in annular channel 3*o*. Four such vanes are shown by way of example in the drawing, the vanes being arranged equidistantly at intervals of 90°. Vanes 235 are seated on stub shafts 236, which extend into the actual vanes 235 from bearing shafts 37 and on which vanes 235 are mounted with the aid of screws 238. Bearing shafts 37 are mounted rotatably in needle bearings 239. They can be swivelled about axes SA, which are located in the partial plane and main plane of rotation E and exerted generally radially to axis of rotation DA of the pump.

Bearings 239 are seated in holes in a hub body 240, which is formed as a flange-like projection on a drive sleeve 241 and leaves a control space 242 free. Drive sleeve 241 is rigidly connected with drive shaft 241 *b* by means of a key 241*a*. Hub body 24*o* is sealed in pump casing 221 with the aid of shaft packing 45. Details of the mounting means for the hub body are not illustrated and can either be arranged in the interior of the casing or in the form of an external bearing block so that the bearings cannot be contacted by any pumped fluid which might seep in.

While the pumping area of the annular channel, pumping portion 54, is thus completely free beneath connecting passageways 31, 32 and is thus of circular cross section with the exception of that portion in which bearing shafts 37 and stub shafts 236 enter therein, the upper sealing portion 55 of the channel is constricted to the thickness d of vanes 235. For this purpose, casing members 221 and 222 are formed in the manner shown in the drawings and indented accordingly in the area of sealing portion 55. In the interior, this thus results in lightly rising end faces 259 of the sealing portion, thereby resulting in a funnel-like transition from the pumping portion to the sealing portion. Formed in the sealing portion are plane sealing faces 60, standing parallel one to the other and arranged at a distance from plane E which corresponds to one half of thickness d/2. Vanes 235 also have plane, parallel pressure surfaces, which fit precisely through sealing portion 55 of the channel, thereby sealing said channel. The length of that area of the sealing portion 55 of the channel providing the actual sealing effect between connecting passageways 31 and 32 is precisely coordinated to the distance between vanes - 90° in the illustrated example - in such a manner that the entering vane is just completely sealed when the preceding vane leaves the sealing portion of the channel. In each case, a portion of the volume is enclosed between the vanes and advanced from outlet passage to inlet passage. In this regard, the pump does have a corresponding loss, which must however be accepted in view of its otherwise favourable characteristics and the possibility of avoiding liquid-level displacement floats in this area.

As can be seen from FIG. 1, the peripheral edges 262 of vanes 235 are curved with radius r so as to provide proper contact and good sealing engagement, as well as compensation for slifht shifting, in all positions. Recessed into peripheral edges 262 are slots 270 in which are arranged sealing strips 271, whose ends 272 are clamped between stub shafts 236 and vanes 235 inserted thereon, while also being fixed with the aid of screws 238. The sealing strips are of plastic or rubber having good sealing, sliding and wearing properties, corresponding to the respective liquids. They can also be designed in the nature of stiff piston rings, if desired with a different sliding and sealing material attached thereto, if desired of an elastic material. Vanes 235, which are generally replaceable components, can be of steel, especially stainless steel, depending upon the liquid employed; In particular, however, they will be fabricated of polyamide or a similar plastic, especially if the pump is to be employed for liquids containing especially unfavourable constituents.

For control of the pump, which is arranged entirely outside the actual pump area, bearing shafts 37 extend into control space 242 and are secured against being forced out radially by means of stop rings 275 and retaining rings 276. Located on their inner ends are stub shafts 265 which are arranged eccentrically to swivel axes SA of vanes 235 with eccentricity *e*. The relative position of eccentric stub shaft 265 to vane 235 is selected in such a manner that connecting plane V between swivel axis SA and roller axis RA is inclined by an angle $\alpha$ of 45° to the central vane plane FME in such a manner that, with vane 235 in that position in which vane 235 travels, in a sealing manner, at right angles to the direction of rotation 34 in sealing portion 54 of the channel, it is inclined toward the main guide flank 311 of cam track 266 (FIG. 3). In plane of rotation E, swivel axes SA are staggered slightly parallel to radii RU, which extend through axis of rotation DA and are also located on plane of rotation E, in such a manner that cam roller axes RA are located generally on radial planes RE, which extend through axis of rotation DA, in the two end positions of vane swivel.

Two cam rollers 283 and 284 of equal size are mounted one behind the other, each independently pivotal of the other, on stub shafts 265 with unillustrated plain bearings or preferably with needle bearings.

There are two cam track members 285 and 286 located at a distance one from the other for swivelling vanes 235. Cam track members 285 and 286 are fixed on an axle 287 with the aid of feather keys 288 and 289 or similar means. Cam track member 285 is clamped in place with the aid of nut 29*o*, which serves only for assembly. It is located in a recess in the inner race 291 of an antifriction bearing 292, with which axle 287 is rotatably guided in sleeve 241. Cam track member 286 is fixed axially with the aid of a shaft retaining ring 294. Axle 287 is mounted in a hat-shaped cover 296, firmly connected with the casing, in such a manner that while it is prevented from rotating by key 295 it can be axially displaced in cover 296. Said cover is bolted to a collar 298 of casing 222 with the aid of screws 297. There is an arrangement for axial adjustment of axle 287 in the area of hat-shaped cover 296. The axle has a thread 300, on which is screwed an adjusting nut 301. Said adjusting nut has an internal clamping slot 302 and a setscrew 303. An external seal 304 seals off a bearing cap 305. Adjusting nut 301 is in a supporting relationship with the inner race 306 of an antifriction bearing which is capable of supporting an axial force and which can be a deep-groove ball bearing, for example, which however is arranged slidably with sufficient play relative to axle 287. The outer race 307 is fixed axially with the aid of a shaft retainer 308 and a stop collar 309. The axial position of shaft 287, and thus of the two cam track members 285 and 286, can be adjusted relative to bearing shafts 37 by rotating adjusting nut 301.

Located on the sides of cam track members 285 and 286, arranged at a distance one from the other, which face each other are the guide flanks, i.e. main guide flank 311 on cam track 285 and secondary guide flank 312 on cam track member 286. Together, they define a parallel cam track 266 which consists of four sections, i.e. section *f*, which corresponds to almost three quarter revolution and which is associated with pumping portion 54 of the channel and which is on a plane which is perpendicular to axis of rotation DA, a second ad, which is staggered parallel thereto in the amount of stroke h and which is associated with sealing portion 55 of the channel and which assumes about one quarter of a revolution, as well as the two transitional sections u on which the cam rollers rise and fall and which cause the vanes to swivel from one end position to the other.

Main guide flank 311 on cam track member 285 is associated only with cam roller 283. Cam track member 285 is designed in such a manner that the main guide flank is only as wide as cam roller 283 so that cam roller 284 can travel freely. Cam track member 285 is relieved within this area.

Located at distance K from section ad of main guide flank 311 and formed from axle 287 is a butting collar 320 having a butting surface 321 for second cam roller 284; said butting collar 320 provides precise guidance on both sides for the cam rollers in the area of the sealing portion of the channel, while also preventing undesired tumbling of vanes 235 in the pumping portion of the channel.

There is one spring mechanism 325 for each vane in order to press cam rollers 283 against main guide flank 311. For this purpose, four hexagon-shaped recesses 327, located, in profile, in the direction of axis of pump rotation DA - as can be seen from FIG. 2 - are formed, by broaching, for example, in a spring element retaining member 326 which is rigidly connected with hub body 240. Seated in said recesses 327 are axially shiftable roller holders 328, which also have a hexagon profile, which have apertures 329 for holding compression springs 330 in the ends which face one another and which have slots 331 at their two outer ends, in which support rollers 332 and 333 are rotatably mounted with the aid of bolts 334 and 335, whereby needle bearings are preferably provided. Cam support rollers 332 are associated with secondary guide flank 312. Support rollers 333 are in a direct supporting relationship with cam rollers 283 and are located on the sides of cam rollers 283 which are opposite main guide flank 311, so that they press against the main guide flank. In the position of rest, the inner ends 337 and 338 of roller holders 328 are located at a distance one from the other which generally corresponds to stroke h of cam rollers 283.

The pump works in the following manner: When the pump is driven by means of shaft 241 *b*, hub body 240 drives vanes 235. In the case of rotation in the direction of arrow 34, the vane egressing from sealing portion 55 of the channel is swivelled, as corresponding cam roller 283 can reach section *u* of main guide flank 311 in the direction of drive shaft 241, i.e. a lower level. At the same time, cam support roller 232 rolls on secondary guide flank 312 and reaches a higher level on transitional section *u*. Both inclines are parallel, so that corresponding spring 330 is not compressed, but both roller holders 328 shift position accordingly, pressing support roller 333 onto cam roller 283, so that said roller is retained against main guide flank 311. Consequently, vane 235 attains a plane which is perpendicular to plane of rotation E in the area of inlet 31. It thus slowly but surely closes off the portion of the volume located in front of it until its outer edge reaches the wall of the pumping portion of the channel. The portion of the volume so enclosed advances through pumping portion 54 of the channel until preceding vane 235 swivels in the area of the outlet since cam roller 283 associated thereto reaches corresponding section u of main guide falnk 311 and is lifted to a higher level there, so that eccentric control stub 265 causes a corresponding swivel motion of such a nature that the main surface of vane 235 is swivelled into plane of rotation E and can pass through sealing portion 55 of the channel. Because it enters entirely, it seals entirely. At this moment, preceding vane 235 leaves sealing portion 55 of the channel, whereby the just described commences again. If coarse constituents enter the pump with the liquid being pumped and prevent the vane from swivelling freely, it is possible for the vane to yield freely to hindrances of this type while still outside the sealing portion of the channel in that corresponding spring 230 compresses and then pushes the vane into the desired position, perpendicular to direction of rotation E, again after the hindering constituent has slid out. There is only rolling friction everywhere, as all elements are rotatably mounted and are pressed one against the other in such a manner that they can play freely. When the vane enters the area of outlet 32, the swivel motion is forced in every case by butting surface 321 of butting collar 320, so that when it enters sealing portion 55 of the channel, it is always swivelled in the direction of rotation. As a result of the spring-loaded support, minor inaccuracies are automatically compensated for at the transition of the individual cam track sections, thereby providing good quietness of operation here also.

The design of the pump can be modified in many ways, in particular with respect to the design and details of the vanes, especially with respect to external sealing. Through the elastic design of the vanes and their sealing strip, the minimum displacement and other inaccuracies can be compensated for very well. Instead of the indicated needle bearings, other bearings, such as plain bearings, are also possible. Multirow needle bearings or individual needle bearings, located one next to the other, can be employed. An appropriate spring mechanism must be associated to each eccentric stub, whereby said mechanism is not limited to the illustrated arrangement with two rollers, but simpler spring mechanisms acting directly on the stubs are also possible or, instead of the support roller, which travels on the cam roller, a spring-loaded connecting rod can also be provided. The employment of cam and support rollers of differing size offers a favourably compact design with optimum operating conditions. Instead of the hexagon design, it is also possible to select different means for preventing rotation, e.g. a design similar to a spline shaft or any other unequally rounded profile. Instead of the illustrated axial adjustment, with which the spring force of springs 330 keeps nut 301 pressed against inner race 306, it is also possible to provide different adjusting means with fixation in both directions. The pump can not only be built with four, but also with five, six or more vanes.

The practical examples shown in FIGS. 4 to 7 shows a pump 420 whose design and method of operation are the same as in the pump shown in FIGS. 1 to 3, with the exception of several advantageous modifications explained below. Like parts are designated by the same reference numerals employed in the first practical example, even if the configuration of the parts differs somewhat from that of the previous parts, however the function remains basically the same. If the configuration of the parts differs greatly or the function or effect differs at all, those parts are numbered between 400 and 600, with the tens and ones digits corresponding to those of the previous reference numerals wherever possible. For this reason, the same, similar or analogous parts are not explained again here, but only the differences. These differences constitute, on the one hand, the different size of vanes and pumping portion of the channel as well as the appropriate design of the sealing rings and adaptation of the radius in the sealing portion of the channel and, on the other hand, primarily the design of the spring means for the control members for the purpose of evasion of the vanes in the event of penetration of foreign bodies.

Bolted to axle 487, which is arranged in such a manner that it cannot rotate relative to pump casing 421 however is capable of axial adjustment to the position of bearing shafts 37, with the aid of nuts 290 is cam track member 485. Cam track member 485 has a main guide flank 311 and a support surface 503 which is in a contacting relationship with ledge 502. In this practical example, cam track member 486 is arranged in the immediate vicinity of cam track member 485. It has a guide neck 504, whose end is designed as a stop 505 and is in a direct contacting relationship with support surface 503. Cam track member 486 is guided in such a manner that it can be shifted axially on section 506 of axle 487, while being secured against rotation by means of feature key 488. It can shift as far as ledge 507 to the left - as viewed in FIG. 4 - and has secondary guide flank 312, which is associated to cam rollers 284. It extends precisely parallel to main guide flank 311. During fabrication, the cam track is preferably milled together when cam track members 485 and 486 are located with surfaces 503 and 505 adjacent. In this manner, guide flanks 311 and 312 extend parallel one to the other at a distance equal to the diameter of cam rollers 283, 284, forming between them a cam track corresponding to cam track 266 in the first practical example.

Figure 4:
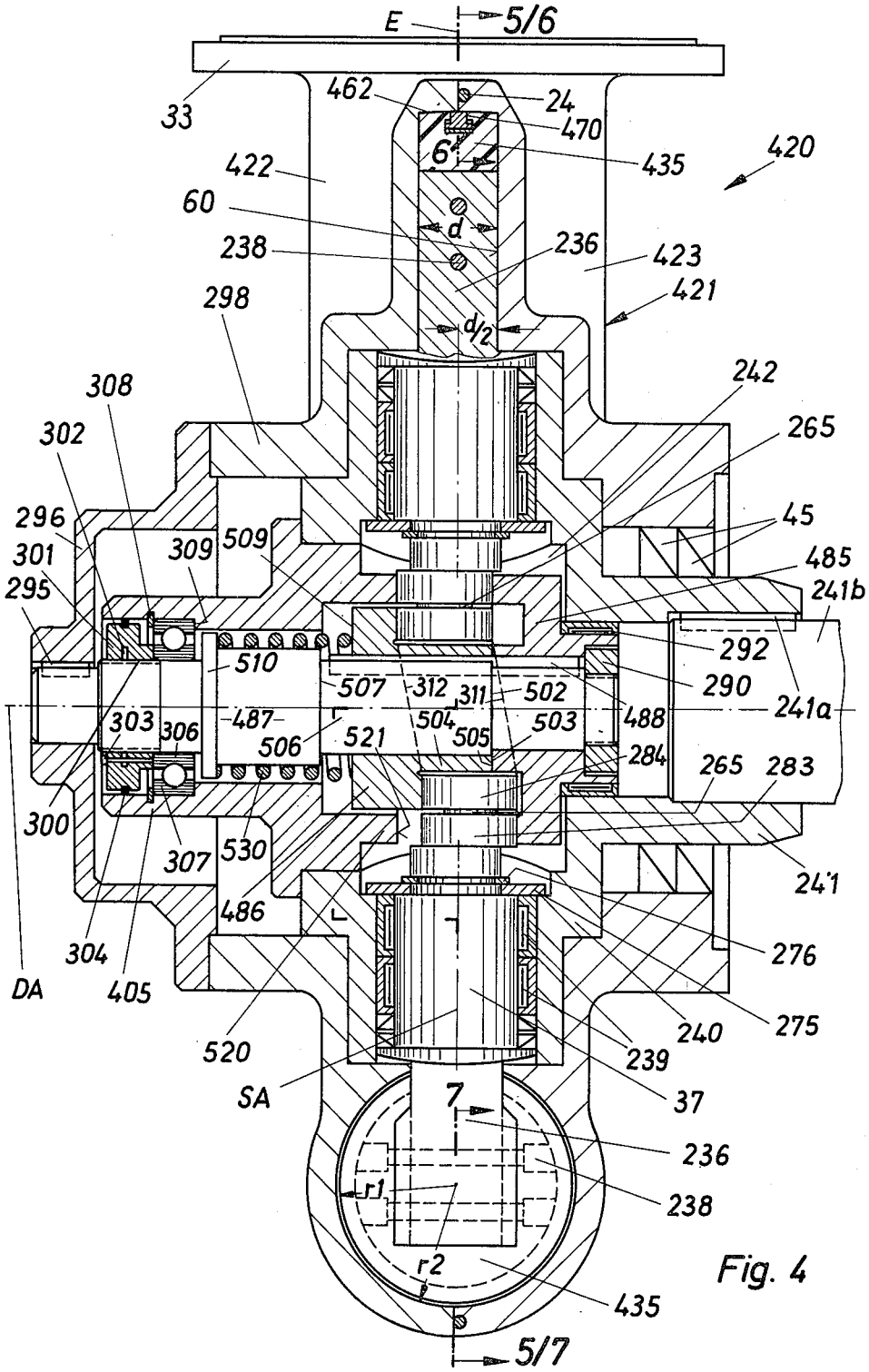
FIG. 4 is a cross section through a second embodiment of a pump in accordance with the invention, the section being taken on line 4—4 in FIG. 5, whereby the section along which the line is taken is not straight, but is partially staggered to better illustrate the vanes and bearing shafts because of the staggered swivel axes.
Figure 5:
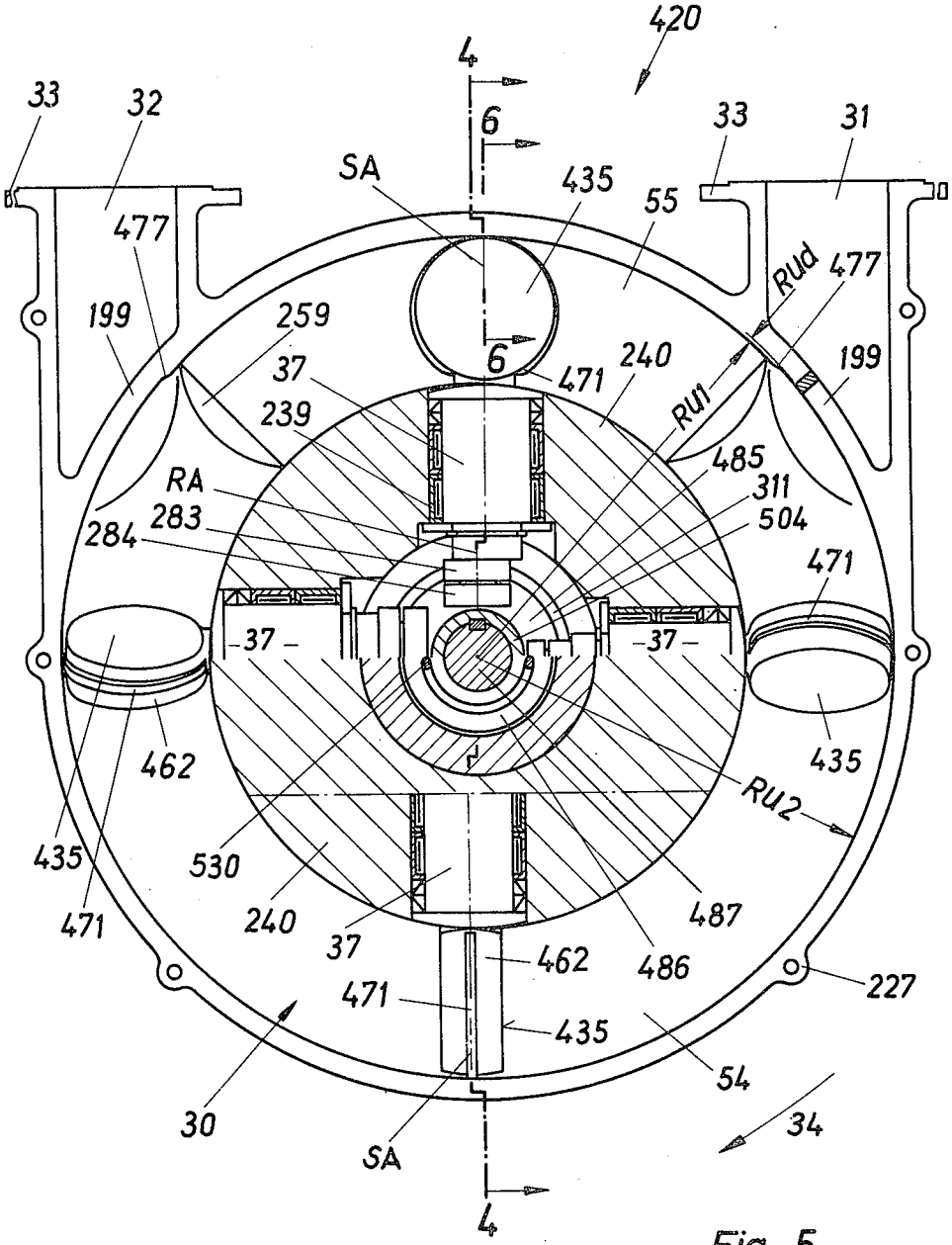
FIG. 5 is a central section through the pump shown in FIG. 4, with the section taken along line 5—5, which, as indicated in FIG. 4, extends to the center - axis of rotation DA - of plane of rotation and partial plane E and which is then displaced to the left in order to show the springs, and which then jumps back to the main plane of rotation and partial plane E in the lower area of the pump again.

Arranged between end surface 509 of cam track member 486 and a collar 510 of axle 487 is a helical compression spring 530, which presses cam track member 486, together with its stop 505, against supporting surface 503, however permits cam track member 486 to give way toward the left - as viewed in FIG. 4 - when foreign bodies, which cause vanes 435 to swivel, penetrate into pumping portion 54 of the channel in pump 420. This spring arrangement corresponds to spring mechanism 325 in the first practical example. However its design is considerably more simple and advantageous for many applications. In actul practice, the one strong helical compression spring 530 will only give way when foreign bodies penetrate. Since the entire cam track would have to give way, the arrangement is less likely to oscillate. On the other hand, however, the first practical example has the advantages of a stationary cam track. Instead of one helical compression spring, it is also possible to provide a plurality of cup springs in the form of a spring package or to provide other spring means.

Instead of butting collar 230 in the first practical example, in this case bearing cap 405 has a butting neck 520, from which butting surface 521 is formed; said butting surface 521 is located at the same level as that component of secondary guide flank 312 located furthest to the left, i.e. at that level which corresponds to sealing portion 55 of the channel. This ensures that, even if cam track member 486 gives way before vane 435 enters sealing portion 55 of the channel, vane 435 will definitely be placed in a proper attitude by cam rollers 283 and 284 and that said cam rollers are supported on both sides by flanks and that the vanes can therefore not be swivelled further than desired. In this practical example, also, the eccentric position of stub shafts 265 corresponds to that of those illustrated in FIG. 3. Here, also, butting surface 521 prevents undesired tumbling of vanes 435 in pumping portion 54 of the channel. Otherwise, the method of operation of the control means and of the pump itself corresponds to that of the previous practical example.

Figure 6:
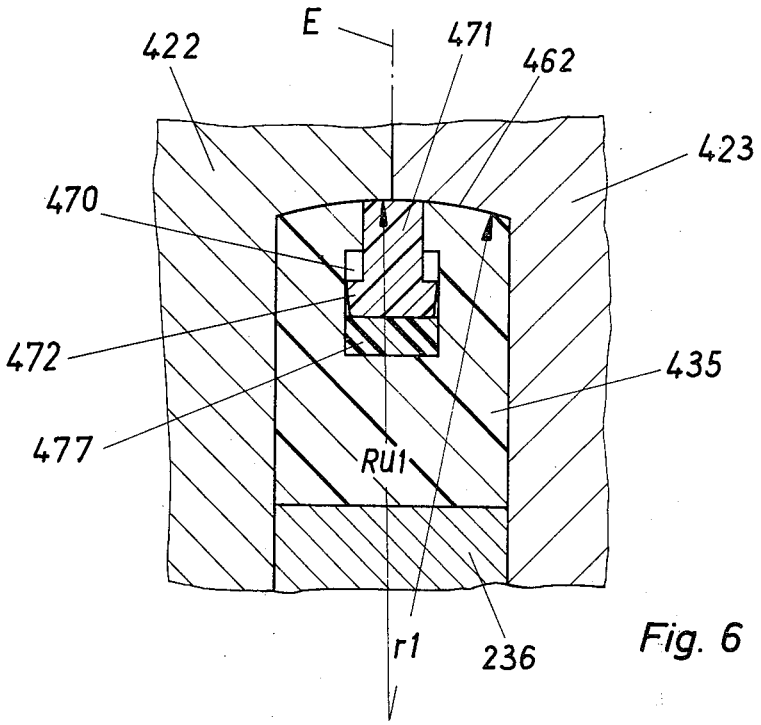
FIG. 6 is a larger partial section taken along line 6—6 in FIG. 5 through the upper portion of a vane, with the sealing ring and the adjacent casing members, in the area of the sealing portion of the channel.
Figure 7:
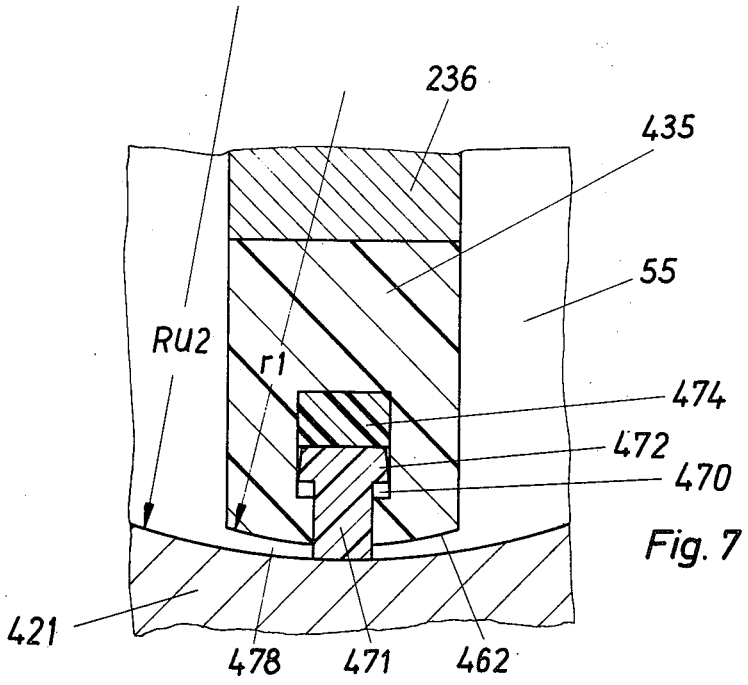
FIG. 7 is a partial section, having the same scale as FIG. 6, taken along line 7—7 in FIG. 4 through the outer portion of a vane with the projecting sealing ring, in the area of the pumping portion of the channel, whereby the plane of the section is rotated 90° to that according to FIG. 6.
Figure 8:
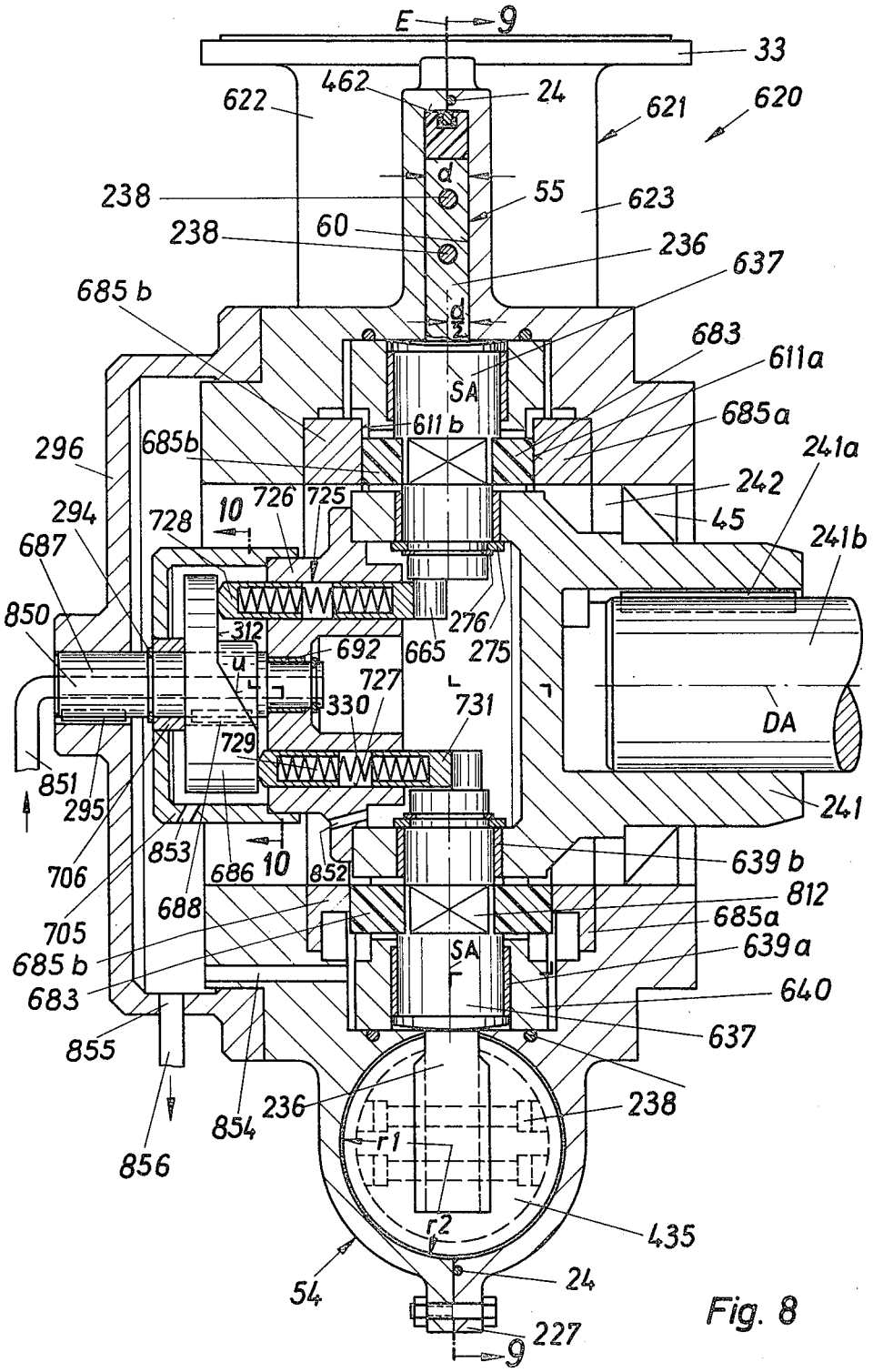
FIG. 8 is a cross section through a third embodiment of a pump in accordance with the invention, the section being taken on the line 8—8 in FIG. 9, whereby the line along which the section is taken is bent - as indicated - in the axis of rotation.
Figure 9:
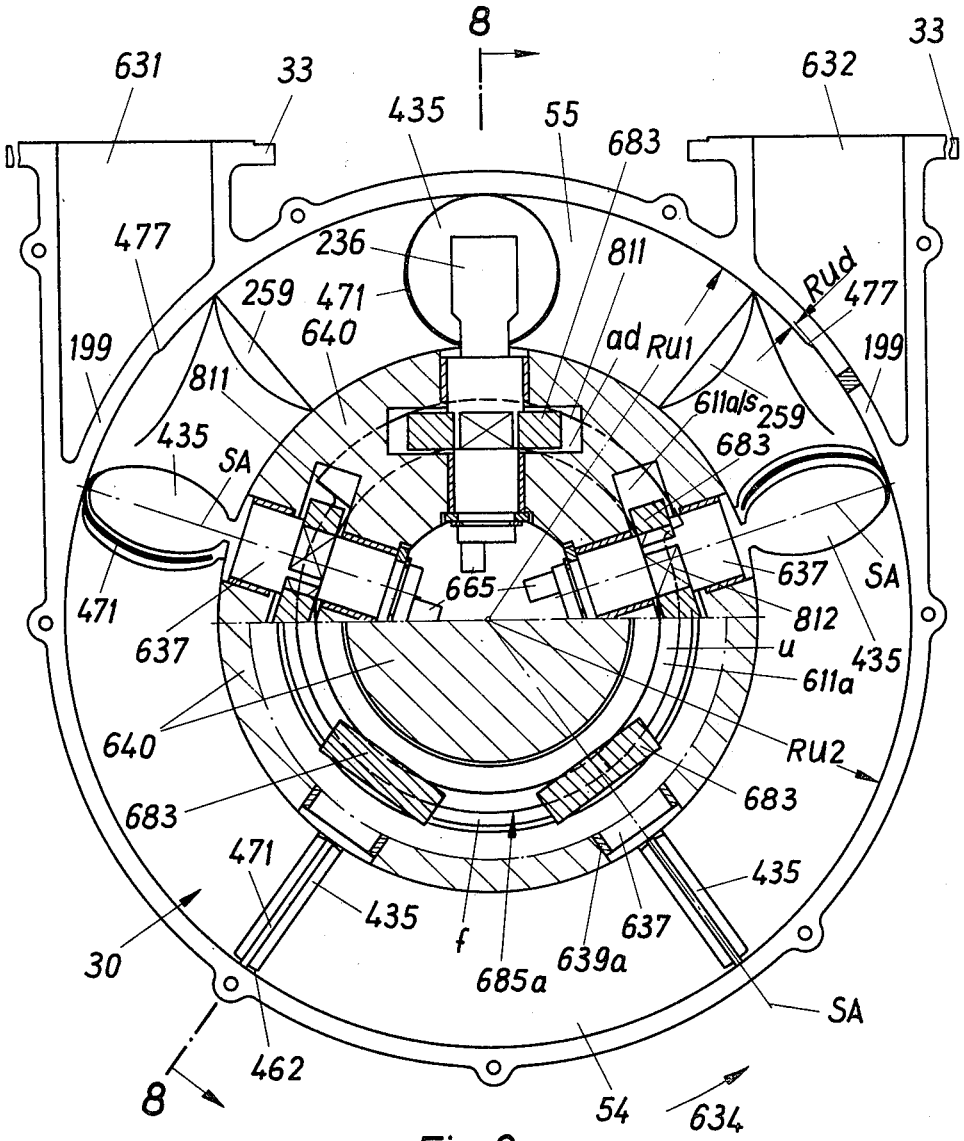
FIG. 9 is a central section through the pump shown in FIG. 8, the section being taken on line 9—9, whereby — as indicated — this line is displaced somewhat to the right beneath the axis of rotation, extending to the lower portion of a bearing shaft, in order to show the attitude of the cam track flank relative to the cam members, and whereby the scale is somewhat smaller than that of FIG. 8.
Figure 10:
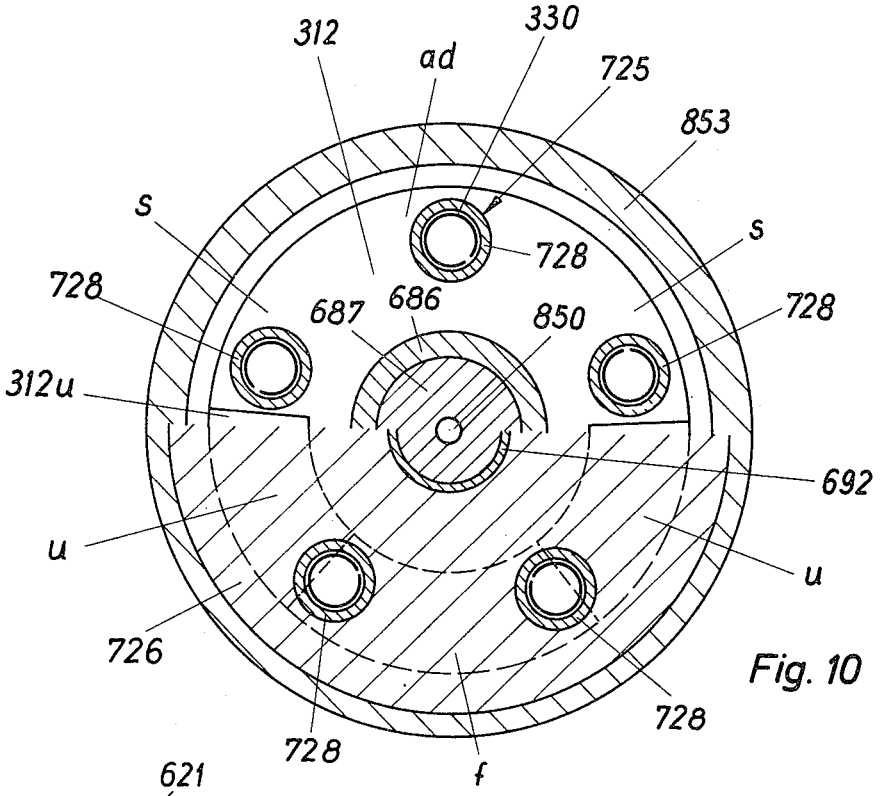
FIG. 10 is a larger partial section taken on line 10—10 in FIG. 8, whereby those members located outside the section are no longer illustrated and whereby the line along which the section is taken is staggered somewhat beneath the axis of rotation in order to show the various components more clearly.

The dimensions of vanes 435 and pumping portion 54 of the channel differ slightly. Peripheral edges 462 of vanes 435 are fabricated with radius $r$ 1, while the cross section of the channel has a slightly larger radius $r$ 2, for example 1 mm to 3 mm (0.04 in to 0.12 in) larger. Thus, an outside peripheral radius RU 2 results for pumping portion 54 of the channel. This minor difference was selected in order to permit vane sealing ring 471 to operate properly. Since the pump is intended for liquids containing relatively coarse constituents as well as impurities or since the pump should avoid damaging sensitive, relatively coarse constituents, both this and the following practical example provide movable seals in the nature of piston rings. As can be seen in FIGS. 6 and 7, sealing rings 471 have T-shaped cross sections. Crosspiece 472 is very narrow. Sealing rings 471 are of a relatively firm, however slightly elastic plastic, for example of an especially high quality polyamide or similar material. In particular, they can also be of polytetrafluorethylene. Worked into each vane 435 is an appropriate T-slot 470. Vanes 435 are also preferably of plastic, for example of polyamide, and, after being placed on relatively wide stub shaft 236, are fixed with screws 238. T-slot 470 is so deep that an elastic element can be located beneath each sealing ring 471. This can be designed in many ways. In particular, it is possible to employ a significantly more elastic resilient strip 477, which can have a hardness of 60 Shore C, for example. All vanes 435 are equipped with T-slots 470, sealing rings 471 and resilient strips 474. These are pressed into slots 470 from the outside. This is possible as vanes and sealing rings are of elastic material and crosspieces 472 are narrow. Resilient strips 474 always press sealing rings 471 outward, so that said sealing rings are in a proper sealing relationship with the wall of the channel. FIG. 7 shows how a sealing ring 471 protrudes slightly beyond peripheral edge 462, thereby bridging gap 478.

If a sealing ring 471 pressed outward in this manner were permitted to run through a sealing portion 55 of the channel having a maximum peripheral radius RU2, this would result in a considerable gap on both sides of sealing ring 471, which would prevent proper sealing between the inlet and outlet passages of the pump. It would be possible to machine an appropriate groove into this portion of the casing. However this would result in the risk of heavy wearing of the corners of sealing rings 471. For this reason, in this preferred practical example the maximum peripheral radius RU1 in sealing portion 55 of the channel is smaller than in the pumping portion of the channel, the difference being the difference between radii r1 and r2 of vanes and cross section of the pumping portion of the channel. This difference is designated RUd in FIG. 5. There is a transition 477 from smaller radius RU1 to larger radius RU2 in the inlet and outlet areas. However, as a result, peripheral edges 462 of vanes 435 are in a precise contacting relationship with the outer surface of sealing portion 55 of the channel, as can be seen from FIG. 6. Reference is also made to the fact that FIGS. 6 and 7 show sections which are staggered 90° relative to one another in order to illustrate the difference in position of the sealing rings. On the one hand, there is very good sealing in pumping portion 55 of the channel with the aid of a sealing ring designed in the nature of a piston ring, while permitting, on the other hand, excellent sealing between vanes and casing in the sealing portion of the channel. Since in this case only the uppermost area of the surface of the vane is sealed and a small wedge-shaped area is formed, this results in very favourable sealing conditions with simple design. Located on both sides of partial plane E in both inlet and outlet passages are narrow bars 199, which extend through the ports and serve to retain and/or better guide relatively coarse constituents, so that said constituents cannot become jammed between vanes 435 and the wall. The cross section of said bars is shown in a sectional representation in FIG. 5.

The practical example shown in FIGS. 8 to 15 shows a pump 620, whose design and method of operation is the same as that of the previously described pump, with the exception of several advantageous modifications explained below. Here, also, like parts are designated with the same reference numerals as those employed in the first practical examples even if the shape of the parts differs somewhat from that of the previous parts, however the function remains the same. If the shape of the parts differs greatly or the function and effect thereof are different, the corresponding parts are designated with numerals between 600 and 800, however the tens and ones digits correspond to the appropriate reference numerals wherever possible. For this reason, the same, similar or analogous parts are not explained here, but only the differences. These differences are primarily in that, instead of cam rollers guided on cam track flanks, one cam now travels between every two guide flanks of a cam track, on the one hand, and there is a spring-loaded support for eccentrics, on the other hand, whereby the design thereof is very similar to that of the first practical exmaple.

In this practical example, there are five vanes 435 arranged equidistantly, i.e. at angles of 72° one from the other. Instead of antifriction bearings, plain bearings are employed here. Since the pump is also suitable for dirt, liquid manure, etc., control space and control members should be able to be rinsed with water.

Mounted in hub body 640 are bearing shafts 637, with two plain bearing bushings **639*a* and 639*b* located at a distance one from the other. Formed between them in hub body 640 is one recess 811 for each bearing shaft, with a cam member 683 located therein. Said cam member 683 is mounted fixedly on bearing shaft 637, with the aid of a square 812, for example. Consequently, the diameter of those portions of bearing shafts 637 located further inward and the corresponding plain bearing bushings 639*b* is smaller. Cam member 683 is arranged between cam track members 685*a* and 685*b*. Said three elements operate conjointly for control, as is explained below. Cam member 683 and cam track members 685*a* and 685*b* are arranged in relatively large circles in the vicinity of pump channel 3*o* in order to provide the maximum possible leverage for controlling the vanes, thereby resulting in improved and more dependable control conditions. Since they surround bearing shafts 637, cam members 683 can be designed in a very large manner. They are approximately the same size as vanes 435. Cam members 683 and cam track members 685*a*, 685*b* are not located in pump channel 3*o*, through which flows the liquid to be pumped, but in that portion of the pump 620 between axis of rotation DA and pump channel 3*o*** in which the control means are contained.

Provided at the inner ends of bearing shafts 637 are eccentric stub shafts 665, which should have the largest possible eccentricity e. A spring-loaded resetting mechanism 725 is associated to each stub shaft 665. Said reseting mechanisms are slidably guided in the direction of axis of rotation DA in a spring element retaining member 726 which is fixed to hub body **64*o*.Each contains a sliding push rod 728 which is in a supporting relationship with auxiliary guide flank 312 of cam track member 686 and an eccentric push rod 731, which is in a supporting relationship with respective eccentric stub shaft 664. Both push rods have blind spring holes 729, in which helical compression springs 330 are in a supporting relationship. The distance between ends 337 and 338 of the push rods corresponds to stroke h of the cam track, as explained in the first practical example on the basis of FIG. 3.**

Cam track member 686 is mounted on axle 687 in such a manner that it is secured against rotation with the aid of a feather key 688 and is in a supporting relationship in the axial direction with a bearing race 706, which is mounted on axle 687 with the aid of a shaft retaining ring 294. Axle 687 is secured against rotation in cover 296 with the aid of feather key 295. Spring element retaining member 726 is rotatably mounted on axle 687 with the aid of plain bearing bushing 692. Secondary guide flank 312 is adapted to main guide flanks 611*a* and 611*b*, as is explained below.

Figure 12:
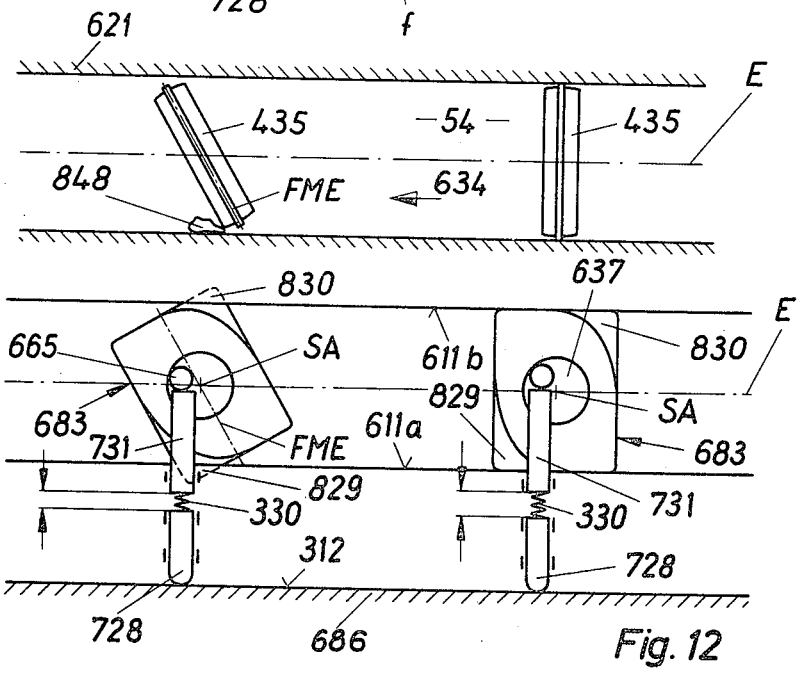
FIG. 12 shows, in the lower portion, a representation, similar to that in FIG. 11, in that section associated to the pumping portion of the channel; the upper portion shows a schematic representation of the pumping portion of the channel, whereby however the position corresponds, and two vanes located therein, of which one vane is swivelled, whereby here also neighbouring components have been left away.
Figure 11:
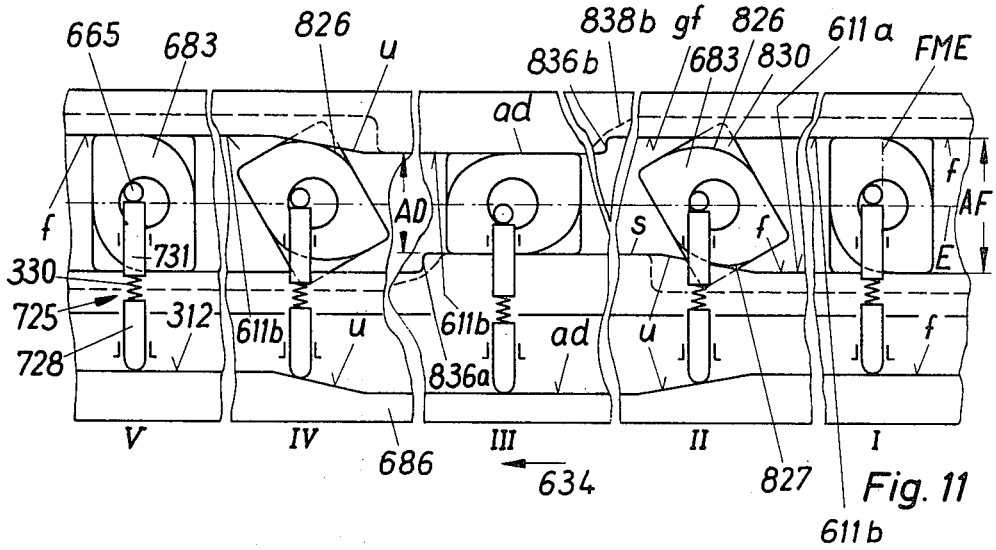
FIG. 11 is a greatly schematicized sequential representation of three cam track flanks, showing the cam member and the sliding push rods, with these components being illustrated in varying positions; the representation is not drawn to scale and shows only the individual, respectively important elements.
Figure 13:
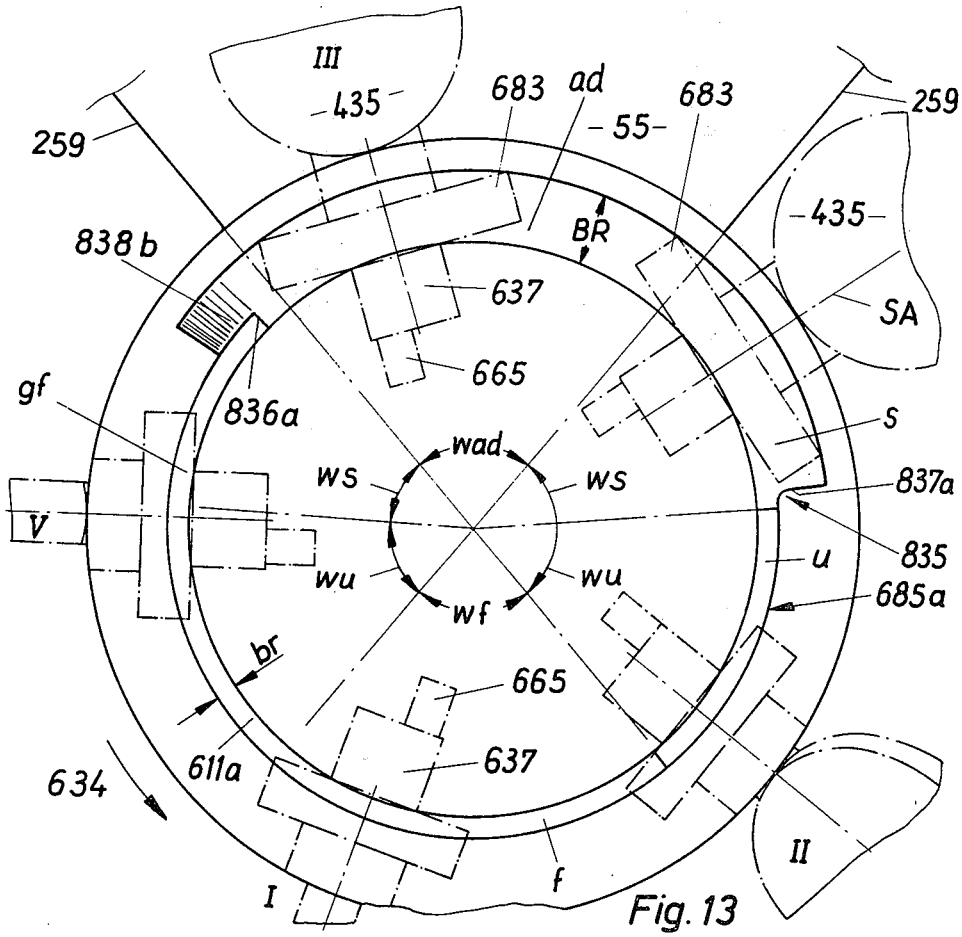
FIG. 13 is a top view of one cam track member, with schematic indication of the sealing portion of the channel and 5 vanes, indicated by dash-dotted lines, with the major components associated thereto shown in a different position than that in FIG. 9, whereby those positions corresponding to the positions in FIG. 11 are indicated with Roman numerals.
Figure 14:
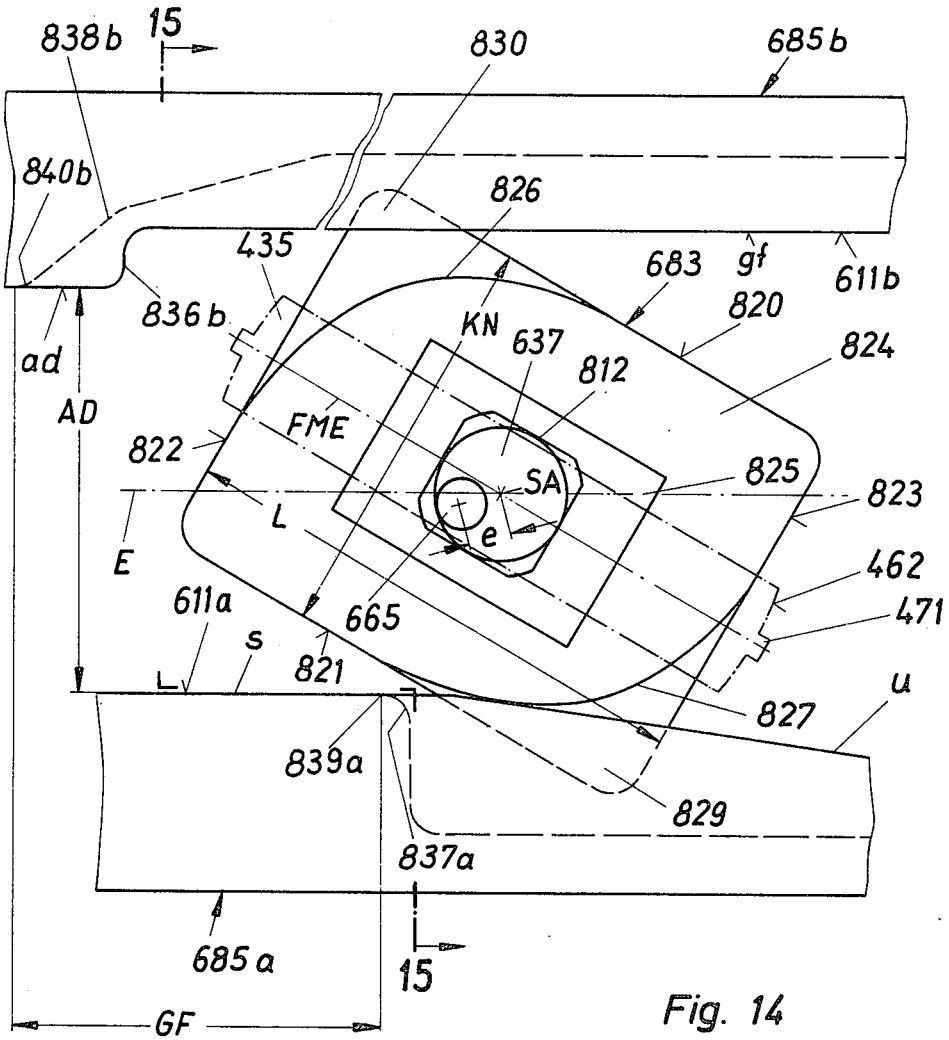
FIG. 14 is an enlarged and highly schematic representation of the cam member - viewed in the direction of the swivel axis - in a position that is somewhat subsequent to position II in FIG. 11, whereby the size is generally life-size, with schematic indication of the neighbouring cam track members, whereby however these members are not illustrated in a rounded manner and whereby neighbouring elements have been left away.
Figure 15:
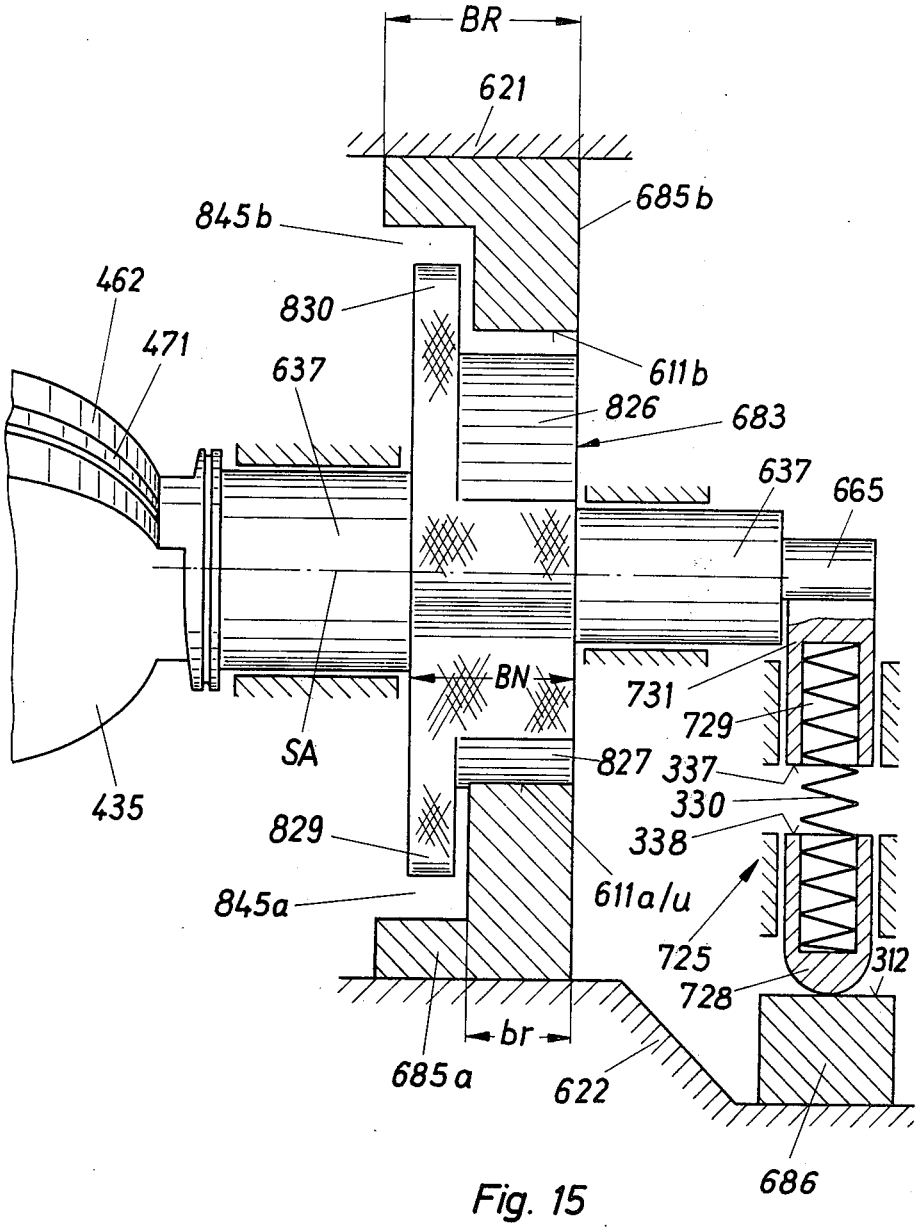
FIG. 15 is a section along line 15—15 in FIG. 14 and is also schematic, whereby the sections of the cam track members are only illustrated in the plane of the section, while the rounded portions of the cam track members, which should actually be able to be seen therebehind, have been left away and whereby the cam member and the bearing shafts are illustrated in the form of en elevation, while the push rods with spring, although not located in the plane of the section, are illustrated in a sectional view and the adjacent portions of the casing are only schematically illustrated below to clearly show the connection.

Cam members 683 and the major associated elements are illustrated in FIGS. 11 to 15, in part schematically. Cam members 683 are illustrated in approximately their natural size in FIGS. 14 and 15. As can be seen from FIG. 14 in particular, their external shape is generally rectangular, with long sides 820 and 821, as well as short sides 822 and 823. They preferably comprise an external plastic portion 824, having this configuration and being placed on a steel core 825. Said steel core 825 is fitted on square surfaces 812 of bearing shaft 637. Two diametrically opposed corners are rounded to the major portion of the width BN of plastic portion 824 in accordance with cam flanks 826 and 827, while corner tips 829 and 83*o* are left on the remainder of the width. Long sides 82*o* and 821 are parallel to central vane plane FME. The representation in FIG. 13 is selected in such a manner as to provide a top view of cam track member 685*a*, while vanes, cams, stud shafts, etc. are indicated by dash-dotted lines, as they are located above the plane of the drawing. Cam track member 685*a* is an annular member having main guide flank 611*a*. In section ad, associated to sealing portion 55 of the channel, it has the very wide width BR, which corresponds to the thickness or width BN of cam member 683. In the remaining area, main guide flank 611*a* has much narrower width br, which corresponds to the circular path of rounded cam surface 827. This difference is necessary in order for corner tip 829 to be able to swivel past beside main guide flank 611*a* in the position of the vanes outside sealing portion 55 of the channel. Cam track member 685*b* is symmetrical to cam track member 685*a*. For this reason, only one track, with the associated elements, will be described completely in detail. Main guide falnks 611*a* and 611*b* travel parallel one to the other in pumping section *f*, associated to pumping portion 54 of the channel, and are arranged at a distance AF one from the other. Said distance corresponds to distance L between short sides 822 and 823 of cam member 683. Both main guide flanks also travel parallel to one another in section ad, associated to sealing portion 55 of the channel, and are arranged at distance AD one from the other. Said distance corresponds to distance KN between the two long sides 82*o* and 821 of cam member 683. The associated angle areas are designated wad for the angle of the sealing portion of the channel and wf for the angle of the pumping portion of the channel in FIG. 13. The direction of rotation here is counterclockwise and is indicated by arrow 634, so that the pump of this practical example rotates contrary to the direction of rotation of the other practical examples. However the pump is also designed for both right and left-handed operation. However this sense of rotation was selected here to better indicate the sequence of conditions. Viewed in a counterclockwise manner - arrow 634 - pumping section f is followed by transitional section u. In this section, main guide flank 611*a* rises continuously by the difference of half the edge length of the cam, i.e. $L/2 - KN/2 = dn$ (cam difference). The transitional area is designated *wu* in FIG. 13. The rise is selected and adapted to the rounding of cam flank 827 in such a manner as to result in a smooth, continuous rolling and swivel motion of cam member 683. For this purpose, transistional area *u* will extend generally sinusoidally, while the transition between the ends of cam flank 827 and short side 823 and long side 821 will be tangential. Otherwise, the distance between cam flank 827 and swivel axis SA reduces uniformly, however in accordance with the rise of the transitional section. The radius of transitional section *u* at the point closest to pumping section f is always greater or at least of the same magnitude as the initial radius of cam flank 827 at its transition to short side 823, in order to provide a precise contacting relationship at all times here. Transitional section *u* is followed by a safety section *s*, which is located at the same level as sealing section *ad*, associated to sealing portion 55 of the channel. In the area of these two sections, main guide flank 611*a* has wide width BR, however, as illustrated at 835 in FIG. 13, it only changes to this full width shortly after having reached the highest level. Corner tip 829 arrives on main guide flank 611 via corner 837*a*, which is either rounded or designed in accordance with a proper cam, in the proper position relative to transitional section u in accordance with an appropriate cam, and is then located on main guide flank 611*a* in safety section *s*. In the area of the entire transitional section *u*, counter flank gf of other main guide flank 611b travels at the level of the pumping section, as shown in FIGS. 11 and 14, top right, so that at that moment in which lower cam flank 827 reaches transitional section *u*, upper cam flank 826 lifts away from main guide flank 611*b*. Second main guide flank 611*b* then changes into sealing section *ad* with *a*, preferably rounded, point of discontinuity in the form of section 836*b*. The area of travel of corner tip 83*o* is recessed accordingly next to main guide flank 611*b*. As illustrated at 838*b*, its transition to the sealing section is preferably designed in a funnel-shaped manner, in order to reliably introduce corner tip 83*o* into the sealing section smoothly and without jars. Distance GF between end 839*a* of rounded corner 837*a* and end 840*b* of funnel-shaped transition 838b on main guide flank 611*b* in sealing section ad corresponds approximately to length L, i.e. to long sides 82*o*, 821 of cam member 683, less the rounded corners of this member. Distance GF can be selected in such a manner that it is somewhat shorter than length L. However it cannot be shortened more than to somewhat more than half of length L. In this case, however, corners 837*a* and transition 838*b* must be designed favourably. This section on main guide flanks 611*a* and 611*b* is designated safety section *s*. When the full width of the entire long side 821 rests on main guide flank, vane 435 will dependably be introduced into the sealing portion of the channel smoothly and without jarring. Both cam track members 685 *a* and 685 *b* are equipped with symmetrical main guide flanks 611*a* and 611*b*. For this reason, the design in safety area *s*, or *ws*, located to the left of sealing angle section wad in FIG. 13, corresponds to the design of safety area *s*, or *ws*, located to the right, explained in detail here, however the corresponding members or points are designated *a* or *b*. In this connection, *a* is associated to lower cam track flank 611*a* in FIGS. 11 and 14, while *b* is associated to upper cam track flank 611*b* in these figures.

Area ad of upper main guide flank 611*b* in FIGS. 11 and 14 is followed by safety section s and transitional section *u*, designed in the same manner as described above and also providing the transition to the level of pumping section *f*. The configuration and location of cam flank 826 corresponds to cam flank 827. Both are symmetrical with respect to rotation with respect to swivel axis SA. Secondary guide flank 312 of cam track member 686 also has transitional sections *u*, which are adapted precisely perpendicular to transitional sections *u* of the two main guide flanks 611*a* and 611*b*, as illustrated very schematically in FIG. 11. The staggered arrangement of reset mechanisms 725, caused by eccentricity *e*, must be taken into consideration in this connection. Otherwise, however, secondary guide flank 312 extends continuously either at level ad or at level *f*. The difference corresponds to stroke *h* of eccentric stub shafts 665 when vanes 435 are swivelled 90°.

This pump is controlled as follows:

When shaft 241*b* is rotated, hub body 64*o* rotates in the sense of arrow 634, for example. When vane 435 is in pumping portion 54 of the channel, this corresponds to position I at the far right of FIG. 11. Short sides 823 and 822 are in a contacting relationship with the narrow portions of main guide flanks 611*a* and 611*b*, and prevent vane 435 from turning clockwise, as viewed in FIG. 11. When moved further in the direction of arrow 634, cam surface 827 reaches transitional area u of main guide flank 611*a*. Since the distance to plane of rotation E of swivel axes SA continuously reduces and main guide flank 611*a* rises in transitional area *u*, cam member 683 swivels in a clockwise manner, as illustrated in position II in FIG. 11, which corner tip 829, as can be seen from FIGS. 11, 14 and especially, 15, reaches the hollow area 845*a* next to main guide flank 611*a*. Simultaneously, upper cam flank 826 moves away from upper main guide flank 611*b*. Here, corner tip 83*o* swivels into hollow area 845*b* next to main guide falnk 611*b*. Simultaneously, eccentric stub shaft 665 swivels, displacing eccentric push rod 731 as well as sliding push rod 728, while the latter descends onto transitional section *u* of secondary guide flank 312. Since the cam is shaped accordingly, spring 33*o* does not compress except to compensate for any irregularities. When cam flank 827 has reached the upper end of transitional section *u*, cam member 683 has swivelled 90° into a horizontal attitude, which is represented by the attitude illustrated as position III in FIG. 11. In this attitude, central vane plane FME is located on plane of rotation E of the vanes. Long side 821 now rests on main guide flank 611*a*. However since spring 330 presses against eccentric stub shaft 665 via eccentric push rod 731, there is a danger of partial return swivel as a result of tolerances, play and the tangential transition between cam flank 827 and side surface 821. For this reason, it is practical to provide a safety path, within which corner tip 829 is sure to reach the wide surface of main guide flank 611a. Safety section s is provided for this purpose. When moving in this section, corner tip 829 reaches section s, in which main guide flank 611a has the full width BR, via rounded corner 837 a. When this had occurred at least in part, corner tip 830 is located beneath funnel-shaped transition 838b of the wide surface of main guide flank 611b, so that cam member 683 is retained properly and vane 435 can enter sealing portion 55 of the channel without any risk of damage. Held by both cam member 683 in sealing section ad between main guide flanks 611a and 611b as well as by vane 435 itself between sealing faces 60, vane 435 now slides through sealing portion 55 of the channel in a sealing manner. After it has left it, cam surface 826 reaches upper main guide flank 611b at the beginning of transitional area u. Sliding push rod 728 now rises on transitional section u of secondary guide flank 312 on cam track member 686. It drives eccentric stub shaft 665 via eccentric push rod 731, thereby slowly swivelling cam member 683, while maintaining a constant contacting relationship between its cam flank 826 and transitional area u of main guide falnk 611b, until cam member 683 has reached an attitude which is perpendicular to direction of rotation E. This sequence is illustrated in positions IV and V in FIG. 11. During the swivel motion, corner tips 829 and 830 again pass the narrow areas of the main guide flanks as described avove, however in the opposite direction. When cam member 683 has reached the actual pumping section f together with associated vane 435 after having passed the safety section and the transitional section, vane 435 seals the pumping portion of the channel and advances the liquid located in front of it to the outlet. Should a coarse constituent 848, as shown at the top of FIG. 12, for example, reach channel 30 during the return swivel sequence in transitional section u or in pumping portion 54 of the channel and attempt to influence the intended motion of vane 435, vane 435 can swivel away yieldingly, causing associated spring 330 to compress slightly. This permits damage to be avoided. Simultaneously, corner tips 829 and 830 swivel into hollow areas 845a and 845b next to main guide flanks 611a and 611b. When the obstacle has been eliminated, vane 435 resumes its normal attitude again under the effect of spring 330. All vanes always rotate in the same manner and can give way if necessary. Since the cams are symmetrical, the pump is suitable for either right or left-handed operation. With appropriate design of the cams, it would also be possible to build pumps which only rotate in one direction.

Instead of the spring means in the push rods with the aid of individual helical compression springs, it is also possible to provide entire spring means for the cam track section of the secondary guide flank, as described in the practical example shown in FIGS. 4 to 7. If the corresponding loss of performance is accepted, it is possible to provide an inclined plane, over which the spring-loaded push rods travel, instead of the precisely fitted secondary guide flank. Compensation is achieved through compression of the springs. It is also possible to eliminate the spring means entirely if pumps are to be built for fluids which do not contain any coarse constituents. In this case, the cam track flanks must be matched one to the other with the corresponding precise degree of exactness. While the pump then no longer provides the advantages of spring-loaded support of the vanes, it still continues to offer the great advantages offered by cam and cam track flank control. These are primarily the advantages that it is possible to initiate the movements of the vanes with significantly greater leverage than is the case with action against eccentrics, while still being able to have the cams rotate in relatively large circles. Thus, the vanes are stabilized very well and fabrication tolerances and wear are not noticed, in a disadvantageous manner, as quickly. As opposed to control means arranged in the actual pump channel, the control means with cams, separate yet in the interior of the pump, also provides the great advantage that the stroke of the cams does not need to be too large, thereby permitting softer turning and rotation of the control members.

Since pump 620 is intended for very coarse liquids and liquids containing dirt, it will not be possible to prevent contamination from entering the control area. Control elements built with plastic cams are relatively insensitive to contamination of this type. However it will be practical to rinse out the dirt. For this purpose, there is a central hole 850 in axle 687, said hole having a connection 851 for water. The water enters the central area from the hole. Further holes 852, 853, 854 and 855 permit the water to reach an outlet 856 again. Holes of this type can also be provided in a different manner in which all corners are rinsed well. The control members are manufactured of or covered with a corrosion-resistant material.

What I claim and desire to secure by Letters Patent is:

1. A rotary piston fluid pump comprising a casing having an annular channel therein, a hub rotatably supported in said casing concentric with said annular channel, said hub comprising a drive shaft portion rotatable in said casing and an overhanging annular flange portion at an inner end of said drive shaft portion and having a central space inside said annular flange portion, said flange portion being disposed wholly radially inwardly of said annular channel of the casing, means providing a fluid tight seal between said hub and said casing, means for rotating said hub, a plurality of circumferentially spaced generally radial shafts extending through and rotatably supported by said annular flange portion of said hub, a flat circular disc-shaped vane mounted on the outer end of each of said radial shafts and disposed in said annular channel whereby upon rotation of said hub, said vanes are carried around in said annular channel, said channel having an arcuate pumping portion of uniform circular cross section corresponding in size to said circular vanes and a sealing portion of restricted cross section corresponding in size and shape to the diametrical cross section of said vanes, inlet and outlet openings at the opposite ends respectively of said pumping channel portion and means for cyclically controlling the rotational orientation of said vanes in said channel as said hub rotates, said controlling means comprising portions of said shafts extending inwardly into said central space inside said annular flange portion of said hub, an eccentric portion on each of said shafts, and opposed cam means acting in opposite directions on said eccentric portions for cyclically turning said shafts to orient said vanes, said cam means comprising means acting resiliently on said eccentric portions normally to position said vanes approximately perpendicular to the direction of movement of the vanes when in said pumping channel portion while permitting said vanes resiliently to give way to solid bodies in the fluid being pumped by swivel motion of the vanes, and means acting positively in both directions on said eccentric portions to position said vanes in line with said direction of movement when entering said sealing portion, the circumferential length of said sealing channel portion being at least slightly greater than the spacing between successive vanes whereby one vane enters the upstream end of said sealing channel portion sufficiently to form a seal therein before the preceding vane exits from the downstream end of said sealing channel portion.

2. A rotary piston pump according to claim 1, wherein said cam means comprises support means which is concentric with said hub and is secured against rotation, cam members mounted on said support means and means for moving said support means axially relative to said casing and securing it in selected axial position.

3. A rotary piston pump according to claim 1, wherein each said eccentric portion comprises an eccentric stub shaft and two rollers independently rotatable on said stub shaft, said cam means comprising a first cam track flank on one side of the path of travel of said eccentric portions engaging only one of said rollers and a second cam track flank on the opposite side of the path of travel of said eccentric portions engaging only the other of said rollers whereby one roller rotates in one direction and the other roller rotates in the opposite direction, thereby avoiding sliding friction.

4. A rotary piston pump according to claim 1, wherein each of said vanes comprises a flat disc-shaped body portion secured on the respective radial shaft and having in its edge a continuous peripheral groove, and a continuous peripherally extending sealing strip in said grove, said sealing strip having a peripheral outer portion protruding slightly radially beyond the periphery of said body portion and formed of low friction wear resistant material and an elastic resilient inner portion resiliently supporting said outer portion against radially inward movement.

5. A rotary piston pump according to claim 4, wherein said peripheral groove in the body portion of the vane is undercut and wherein said sealing strip comprises an outer strip having an enlarged inner portion retained in said undercut groove, and a continuous inner strip of more elastic resilient material.

6. A rotary piston pump according to claim 4, wherein the outer radius of said sealing channel portion is slightly smaller than that of said pumping channel portion, whereby said sealing strip at the radially outermost portion of a vane is pressed into said groove when said vane is in the sealing channel portion.

7. A rotary piston pump according to claim 4, wherein said outer portion is of relatively firm but slightly elastic plastic material and said inner portion is of more elastic resilient material having a hardness of about 60 Shore C.

8. A rotary piston pump according to claim 4, wherein opposite ends of said sealing strip are clamped between said body portion and said radial shaft.

9. A rotary piston pump according to claim 1, wherein said cam means includes a first stationary cam track flank on one side of the path of travel of said eccentric portions, means for resiliently holding said eccentric portions against said cam track flank when the respective vanes are in said pumping channel portion and a second stationary cam track flank on the opposite side of the path of travel of said eccentric portions positioned positively to hold said eccentric portions against said first cam track flank when the respective vanes enter said sealing channel portion.

10. A rotary piston pump according to claim 9, wherein said second cam track flank has a portion spaced from said first cam track flank a distance greater than the diameter of said eccentric portions but less than said diameter plus the maximum lateral movement of said eccentric portions to permit limited swivelling of said vanes when in said pumping channel portion.

11. A rotary piston pump according to claim 9, wherein said means for resiliently holding said eccentric portion against said first cam track flank comprises a third cam track flank movable toward and away from said first cam track flank and spring means resiliently urging said third cam track flank toward said first cam track flank.

12. A rotary piston pump according to claim 11, wherein said third cam track flank is parallel to said first cam track flank.

13. A rotary piston pump according to claim 12, comprising means for limiting movement of said third cam track flank toward said first cam track flank to a position in which the distance between said first and third cam track flanks is substantially equal to the diameter of said eccentric portions.

14. A rotary piston pump according to claim 12, comprising means for limiting movement of said third cam track flank away from said first cam track flank and thereby limiting swivel movement of said vanes when in said pumping channel portion.

15. A rotary piston pump according to claim 11, wherein said cam means comprises an axle which is concentric with said hub and is secured against rotation, means defining said first cam track flank being fixed on said axle and means defining said third cam track flank comprising an annular member axially slidable on said axle.

16. A rotary piston pump according to claim 15, wherein said spring means comprises a compression coil spring surrounding said axle and pressing on said annular member.

17. A rotary piston pump according to claim 15, wherein said axle is movable axially and in which means is provided for moving said axle axially relative to said casing and securing it in selected axial position.

18. A rotary piston pump according to claim 9, wherein said means for resiliently holding said eccentric portions against said first cam track flank comprises a third cam track flank spaced axially from said first cam track flank and resilient cam follower means rotating with said hub and acting between said third cam track flank and said eccentric portions resiliently to urge said eccentric portions against said first cam track flank.

19. A rotary piston pump according to claim 18, wherein said third cam track flank is parallel with said first cam track flank.

20. A rotary piston pump according to claim 18, wherein said cam means comprises support means which is coaxial with said hub and is secured against rotation, cam members mounted on said support means and providing said first, second and third cam track flanks and means for moving said support means axially relative to said casing and securing it in selected axial position.

21. A rotary piston pump according to claim 20, comprising bearing means rotatably connecting said cam follower means with said support means for axial movement therewith and for rotation with said hub.

22. A rotary piston pump according to claim 18, wherein said resilient follower means comprises for each vane a first end portion bearing on said third cam track flank, an aligned second end portion bearing on said eccentric portion, means guiding said end portions for movement toward and away from one another and spring means acting between said end portions and tending to push them apart.

23. A rotary piston pump according to claim 22, wherein said means for guiding said end portions comprises a coaxial guide member rotating with said hub and having axially extending bores receiving said end portions.

24. A rotary piston pump according to claim 22, comprising means for limiting movement of said second end portion toward said first cam track flank to a position in which the distance between said second end portion and said first cam track flank is substantially equal to the diameter of said eccentric portions.

25. A rotary piston pump according to claim 22, comprising means for limiting movement of said second end portion away from said first cam track flank and thereby limiting swivel movement of said vanes when in said pumping channel portion.

26. A rotary piston pump according to claim 22, wherein a roller rotatably mounted on said first end member engages and runs on said third cam track flank.

27. A rotary piston pump according to claim 26, wherein a roller rotatably mounted on said second end member engages said eccentric portion.

28. A rotary piston pump according to claim 27, wherein each said eccentric portion comprises an eccentric stub shaft and a roller rotatable on said stub shaft, said roller on said stub shaft engaging said first cam track flank and the roller on said second end portion of said resilient means, whereby said roller on said stub shaft is free to roll on said first cam track flank.

* * * * *